US006161885A

United States Patent [19]

Walker

[11] Patent Number: 6,161,885

[45] Date of Patent: Dec. 19, 2000

[54] WATER BOTTLE LIFTING STRAP

[76] Inventor: Alvin M. Walker, 143 Lake Shore Dr. North, Palm Harbor, Fla. 34684

[21] Appl. No.: 09/457,666

[22] Filed: Dec. 9, 1999

[51] Int. Cl.[7] ..... B65D 25/28

[52] U.S. Cl. ..... 294/31.2; 294/150; 294/165

[58] Field of Search ..... 294/15, 27.1, 31.2, 294/137, 150, 165; 24/30.5 P, 16 BP; 215/396, 397, 399

[56] References Cited

U.S. PATENT DOCUMENTS

| | | | |
|---|---|---|---|
| 2,325,841 | 8/1943 | Faber | 294/31.2 |
| 3,794,370 | 2/1974 | Lockhart et al. | 294/31.2 |
| 4,656,566 | 4/1987 | Kelley | 294/31.2 |
| 4,834,438 | 5/1989 | Haidet | 294/31.2 |
| 4,866,813 | 9/1989 | Dupont | 294/31.2 |
| 5,042,114 | 8/1991 | Parrish | 294/165 |
| 5,255,947 | 10/1993 | Schwartz | 294/31.2 |
| 5,566,870 | 10/1996 | Mejeur | 294/31.2 |
| 6,003,208 | 12/1999 | Christian et al. | 24/30.5 P |

FOREIGN PATENT DOCUMENTS

| | | | |
|---|---|---|---|
| 2172872 | 10/1986 | United Kingdom | 294/31.2 |

*Primary Examiner*—Dean J. Kramer
*Attorney, Agent, or Firm*—John S. Hale; Gripple & Hale

[57] ABSTRACT

A lifting and securing strap assembly constructed of flexible plastic comprising a flat strap body with an integral handle positioned about the midpoint of the strap and a locking and releasing mechanism on one end and the other end from a notched locking portion.

17 Claims, 5 Drawing Sheets

WATER BOTTLE LIFTING STRAP

RELATED APPLICATIONS

There are no related cases with the present application.

BACKGROUND OF THE INVENTION

1. Field of Invention

The present invention generally relates to the field of holders for containers such as water bottles but more particularly is directed to a flexible plastic lifting strap which can be placed around conventional water bottles and secured thereto to hold and lift water bottles for depositing same into water coolers.

2. Description of the Prior Art

A number of holders for water bottles or canteens and other articles are known in the prior art. The prior art contains many references directed to towards strap devices which are utilized for holding various kinds of water and beverage containers. One patent of interest, U.S. Pat. No. 2,013,950 to Davidson of Sep. 16, 1935 discloses a milk can carrier using an adjustable leather belt worn by the carrier which holds a metal frame and a harness which loops over the mouth of a milk can. Another patent of interest is U.S. Pat. No. 5,806,730 to Deno dated Sep. 15, 1998. This patent discloses a holder for a container with a plurality of flexible retaining straps which are wrapped around the container and fastened to each other with Velcro type hook and loop elements. The flexible straps are looped under the base of the container and around the cylindrical body of the container.

Similarily, U.S. Pat. No. D283,758 issued to Stewart et al. on May 13, 1986 discloses a cylindrical beverage can holder held by a strap with loops at both ends. The loops are placed through brackets formed on the can holder body and held around the can holder body to support the same.

In addition to the aforenoted patents, other patents of interest which relate to the carrying devices are U.S. Pat. No. 5,782,390 to Dorney issued Jul. 21, 1998 for a detachable strap hanging around a user's neck to carry a glass or plastic beer container. The container is held with velcro fasteners; U.S. Pat. No. 5,407,110 to Marsh, Jr. issued Apr. 18, 1995 for a neck strap with a double circular strap suspension for holding a beverage container. Each of the circular straps are held together with bayonet type fasteners; U.S. Pat. No. 5,147,079 to Heather issued Sep. 15, 1992 for a strap carrier device for containers, U.S. Pat. No. 4,911,562 to Mazzeschi issued Mar. 27, 1990 for a strap suspension for a container; and U.S. Pat. No. 1,825,897 to Brooke issued Oct. 6, 1931 for a water bottle carrier strap having a circular fixed body or ring which encircles the lower cylindrical portion of the bottle and an upper ring which encircles the neck of the bottle. Both rigns are connected by a strap handle.

SUMMARY OF THE INVENTION

In response to the needs still left unresolved by the prior art devices; the present invention contemplates the use of a flexible plastic strap assembly which can be fastened around water bottles of any size, tightened and locked in place to provide a sling for lifting and carrying the water bottles to the designated area. Currently water bottles are grasped by the neck and the rear and carried to the water cooler where they are lifted onto the water cooler. Thus it is cumbersome to carry one or more water bottles to the end destination resulting in dropping the same or in back and foot injuries. Furthermore such a carrying action deposits bacteria, viruses and other organisms on the mouth and neck of the water bottle and when the neck is immersed or the seal punctured, provides a growing place and medium for harmful bacterial and virus. It is well known that human hands are a prime carrier of disease and are a primary transmitter of the flu virus and other host to host transmitted diseases.

It is thus an object of the invention to provide a sanitary lifting mechanism for water bottles.

It is also an object of the invention to provide a way of easily transporting water bottles.

It is a further object of the invention to provide a transporter strap which is easily installed around a water bottle, locked and released.

These and other objects, advantages, and novel features of the present invention will become apparent when considered with the teachings contained in the detailed disclosure along with the accompanying drawings.

DETAILED DESCRIPTION OF PREFERRED EMBODIMENT

The preferred embodiment and the best mode of the present invention is shown in FIGS. 1 through 6.

The present inventive flexible water bottle lifting and securing strap assembly 10 allows a water bottle 50 to be easily lifted and carried to a water cooler so that the bottle 50 is mounted on the water cooler. The preferred material used to construct the flexible lifting and securing strap is plastic and the preferred plastic used with the invention is nylon. It is also envisioned that high density polyethylene or polypropylene could be used. It also the preferred embodiment that the entire strap is integrally molded and consists of a single integral piece of plastic.

Figure 1:
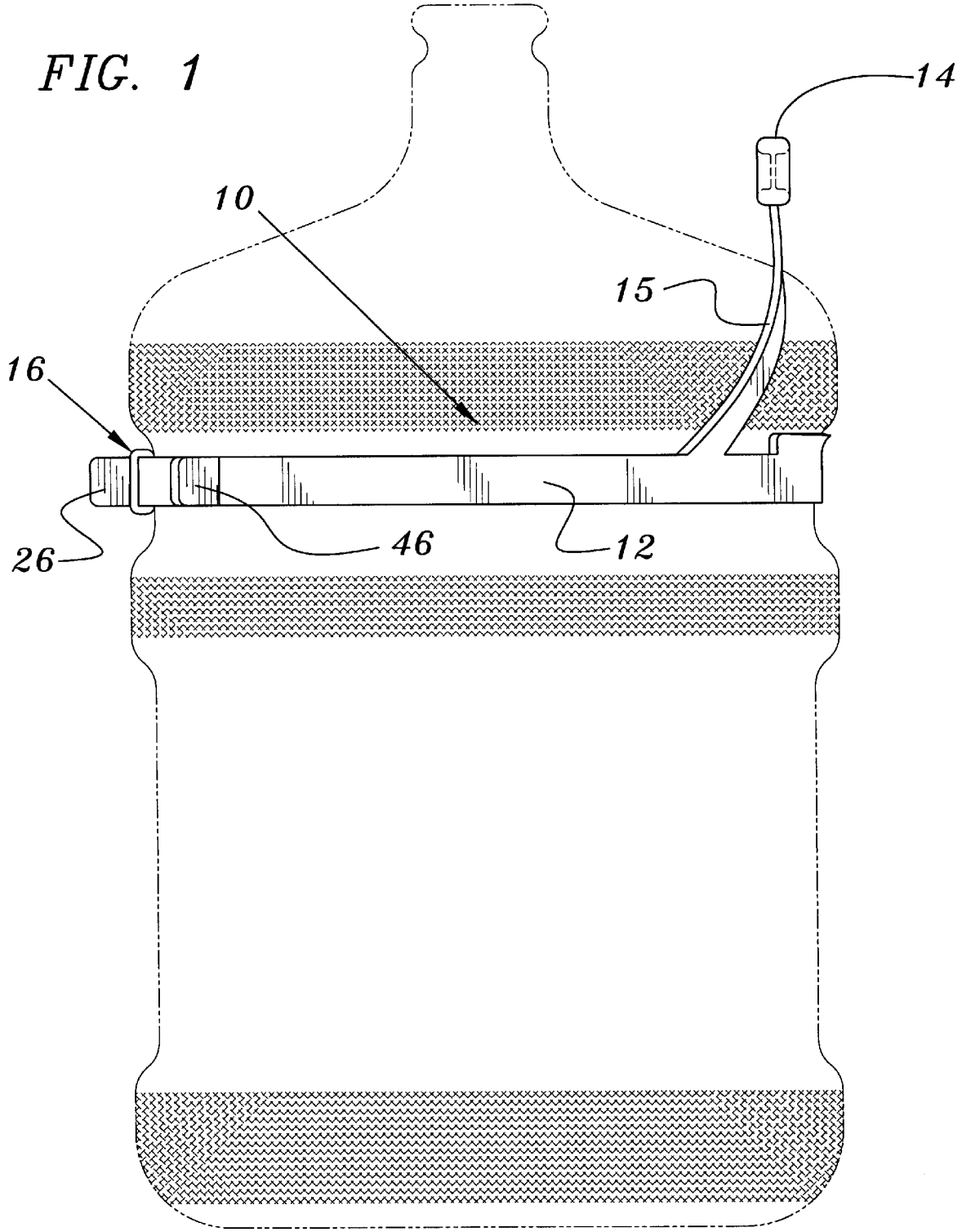
FIG. 1 is a perspective view of the inventive water bottle lifting and securing strap placed around and holding a water bottle.
Figure 2:
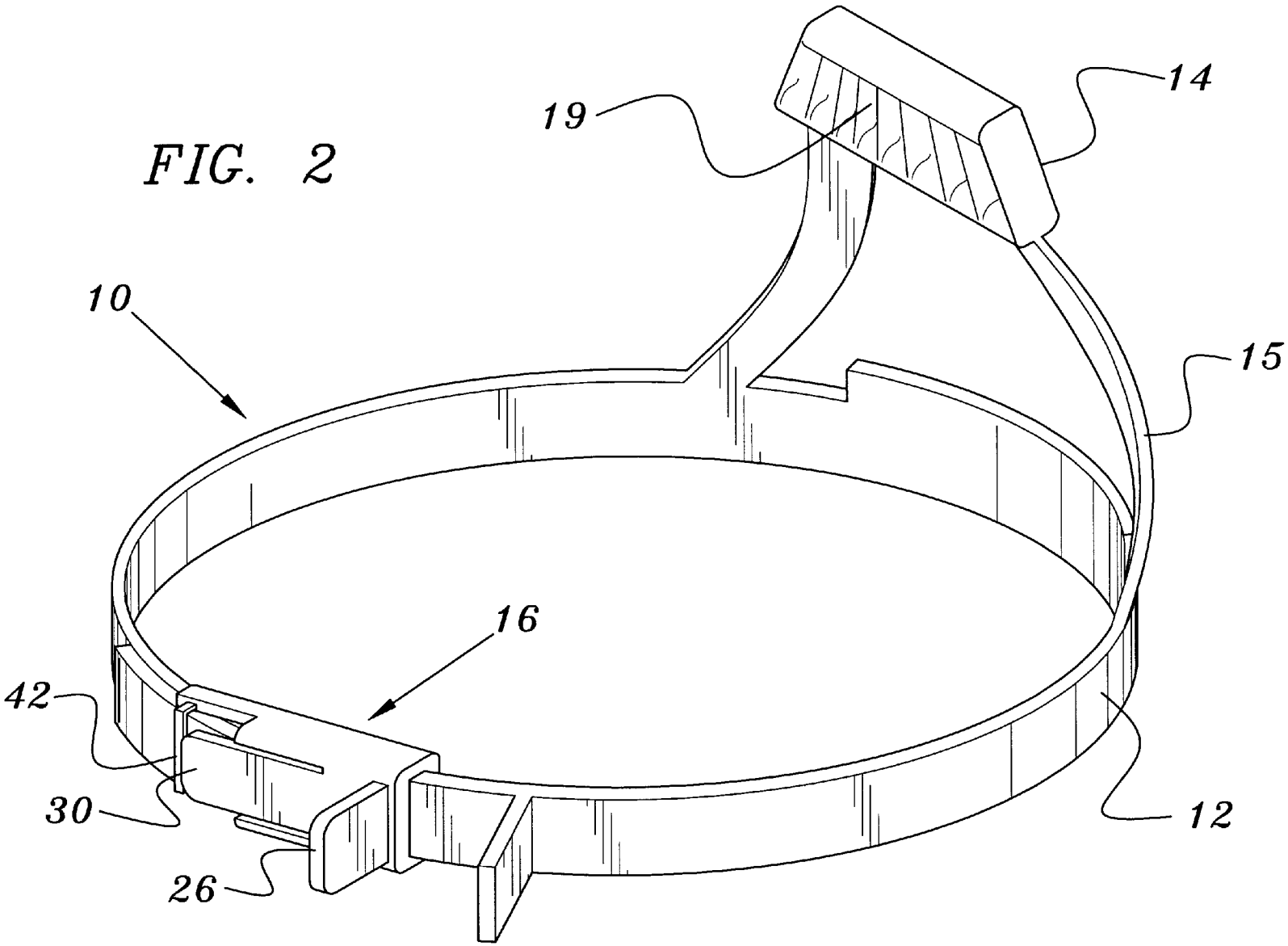
FIG. 2 is an isolated perspective view of the inventive water bottle lifting and securing strap shown in FIG. 1.
Figure 3:
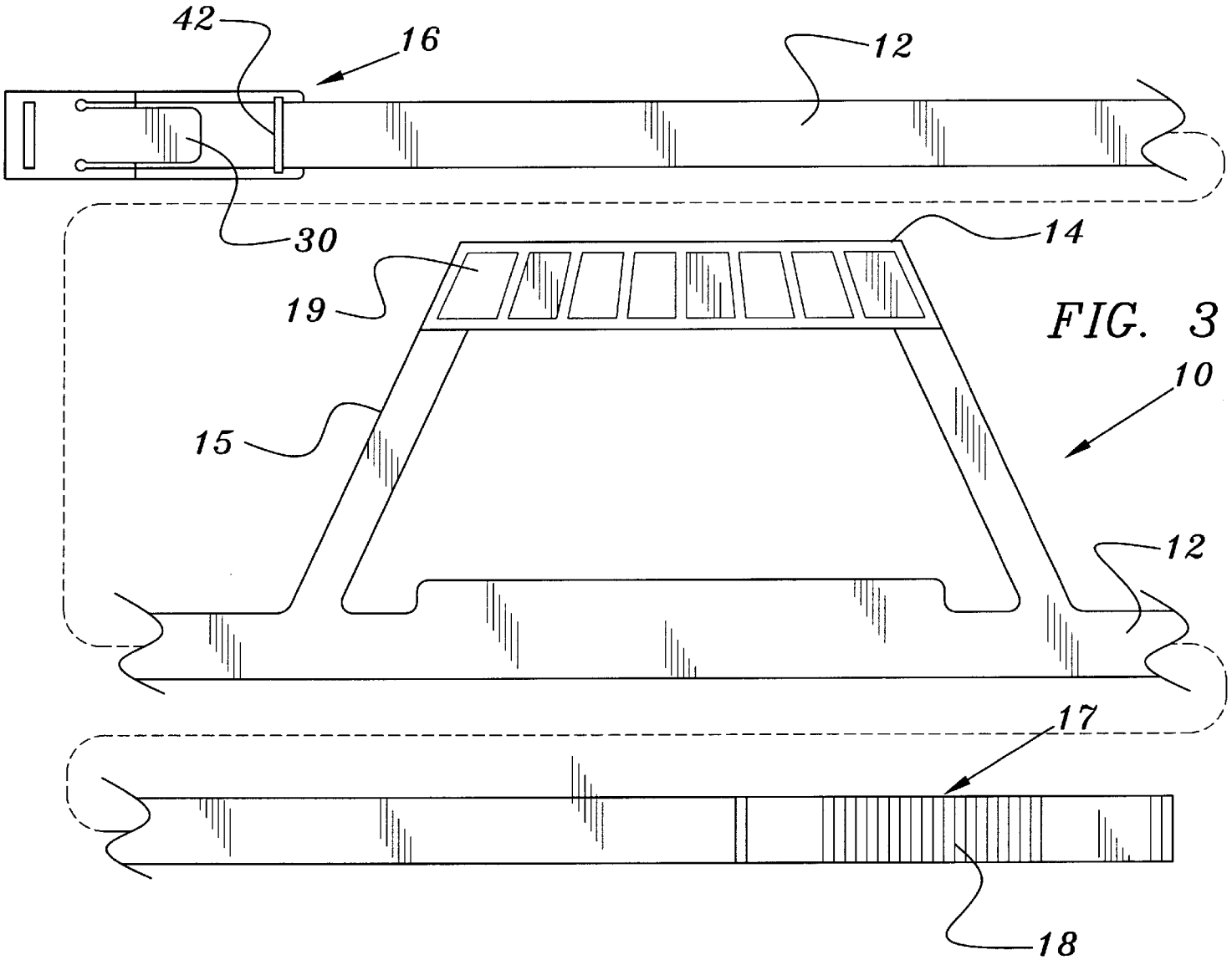
FIG. 3 is a side elevational view of the lifting and securing strap shown in FIG. 1.
Figure 4:
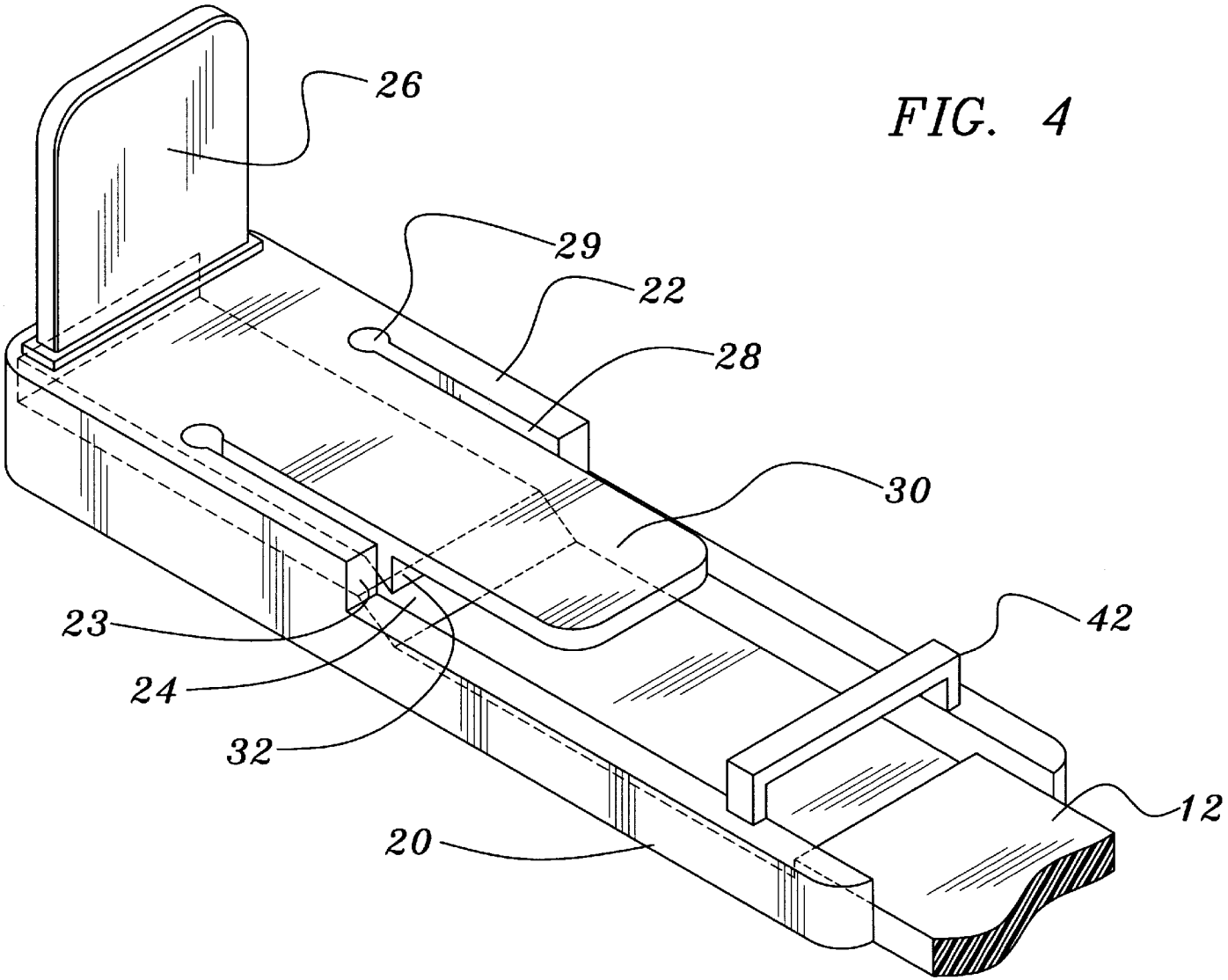
FIG. 4 is an enlarged perspective view partially in phantom of the locking assembly of the lifting and securing strap shown in FIG. 3.
Figure 5:
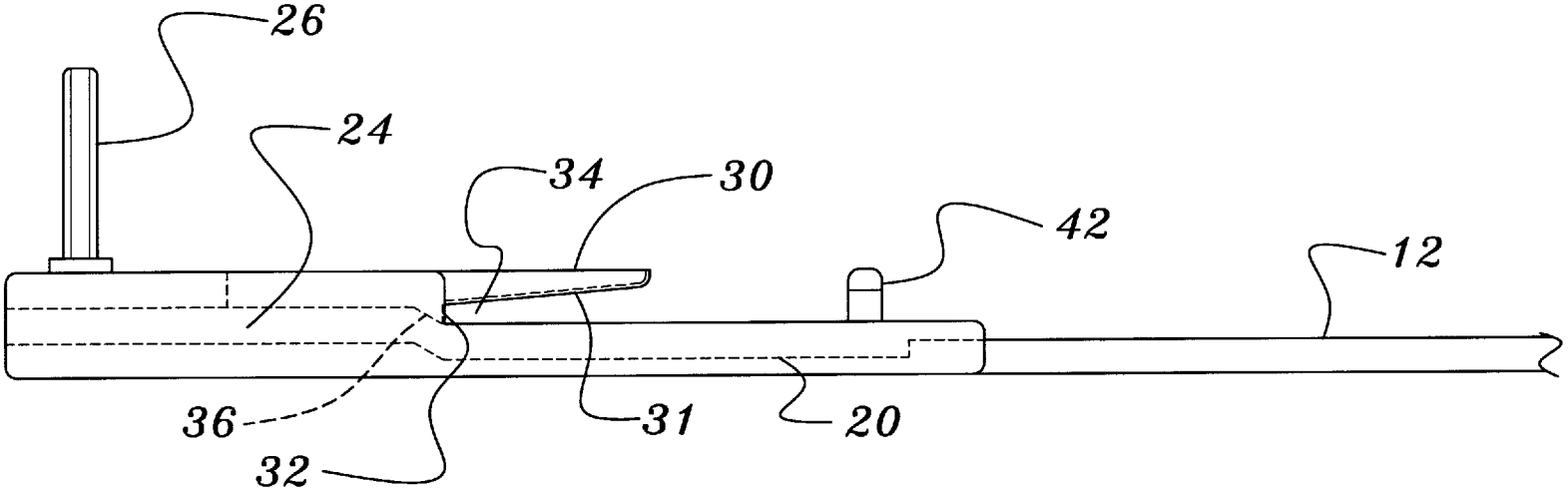
FIG. 5 is an enlarged side cross sectional view of the locking assembly shown in FIG. 4 taken along the center longitudinal axis of the locking assembly.
Figure 6:
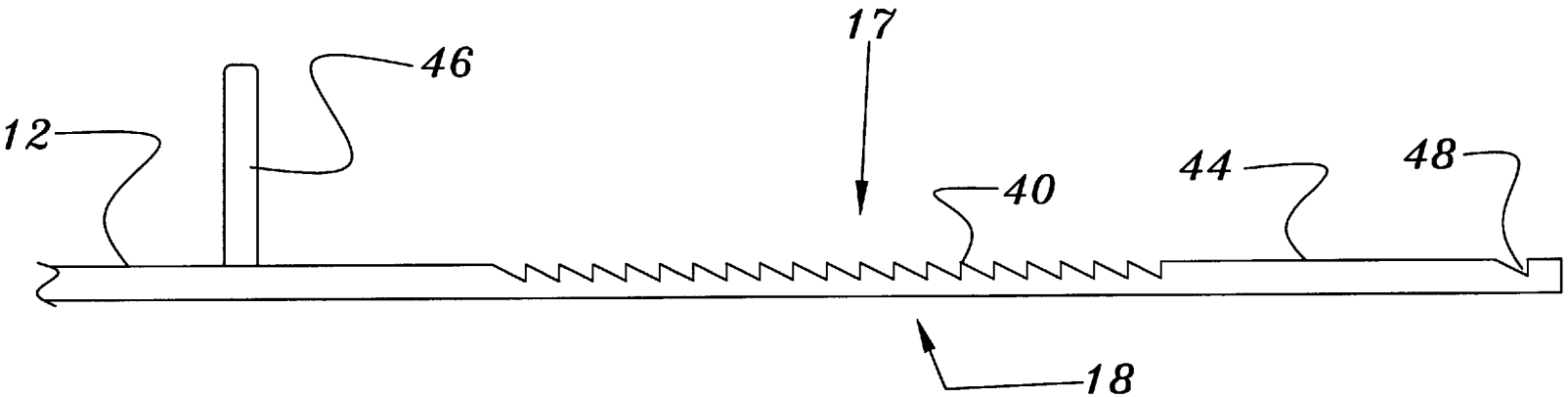
FIG. 6 is an enlarged side elevational view of the rachet end portion of the lifting and securing strap shown in FIG. 3.

The water bottle lifting and securing strap assembly 10 has a flat linear body 12 with a handle 14 connected thereto by arms 15 at about the mid-point of the strap. The arms 15 are angled toward each other so that the handle, arms and section of the strap between the arms forms a trapezoid. The handle 14 is molded with plurality of individual grips 19 to aid in the ease of grasping and carrying a water bottle 50 when the same has been secured with the lifting strap. One end of the strap assembly is provided or formed with a locking and releasing mechanism 16 while the other end 17 is formed with a locking tooth or notch construction 18. The locking and releasing mechanism 16 as best shown in FIGS. 4 and 5, is constructed with a wide flat base section 20 having a greater width then that of the strap body 12 and having a stepped upper section 22 defining a flat walled throughgoing channel 24 which receives and guides the distal end 17 of the strap assembly 10. The distal end of the upper section 22 is provided with an upwardly projecting tab member 26 extending therefrom at an angle of about 90°. The upper wall of the upper section 22 has two parallel grooves 28, each terminating in a circular cutout 29 cut there through to define the rear portion of a planar tongue release member 30 which is parallel to the second lower step or base section 20. The front portion of the tongue member 30 extends past the end step 23 forming the end of upper section 22. The lower surface 31 of the tongue release member 30 is tapered to allow easy griping and has a locking rib 32 integrally formed therewith which is positioned transverse to the longitudinal axis of the tongue release member 30 and extends across the width of the tongue release member 30. The locking rib 32 has a vertical face 34 and an angled face 36 preferably at a 45° angle which angularly extends back from the vertical face to form an angle which is complimentary to the angle formed by the locking notches 40 formed on the leading end 17 or locking tooth construction 18. A guide loop 42 is secured on the proximal end of the base section 20 to receive, guide and hold the end 17 of the strap. Each notch 40 is cut transverse to the longitudinal axis of the strap and is configured with a vertical face and an intersecting angular face which is complimentary to the configuration of locking rib 32. The front end of the strap is formed with an initial holding notch 48, followed by a smooth planar surface 44 leading to the plurality of notches 40 and an end stop 46 which extends transverse from the plane of the strap allowing easy grasping of the strap end while limiting the insertion of strap end 17 into the locking and releasing mechanism.

In operation the strap 12 is placed around a water bottle 50 and end 17 is inserted into channel 24 past the locking rib 32 until the strap is snug and tight against the body of the water bottle 50 and the locking rib 32 engages or fits into a locking notch 40. The locking rib 32 when engaged fits into a locking notch 18 (40) keeping the strap 10 in fixed, snug position around water bottle 50. The end 17 of the strap is placed through the guide loop 42 keeping the same in place and from becoming loose or bent. Stop 46 keeps the strap from being to deeply inserted into the locking and releasing mechanism. When it is desired to release the strap 10 from the water bottle 50, the release tongue 30 is lifted up thus lifting the locking rib 32 away from the locking notch 18 and the strap 10 is slid out of the releasing and locking mechanism 16 thus releasing the water bottle 50 from the grip of the strap 10.

In the foregoing description, the invention has been described with reference to a particular preferred embodiment, although it is to be understood that specific details shown are merely illustrative, and the invention may be carried out in other ways without departing from the true spirit and scope of the following claims:

What I claim is:

1. A lifting and securing strap assembly comprising a strap body, a handle mounted to said strap body, a locking and releasing mechanism formed on one end of said strap body and a toothed section formed on the other end of said strap body adapted to be releasably held in said locking and releasing mechanism, said locking and releasing mechanism comprises a base section, a stepped section positioned above said base section defining a throughgoing channel and a moveable locking tab mounted to said stepped section, said moveable locking tab comprising a tongue member extending out past said stepped section substantially parallel to said base section and a locking member secured to and extending from said tongue member, said locking member being positioned across a lower wall of said tongue member.

2. A lifting and securing strap assembly as claimed in claim 1 wherein said handle extends from said strap body at about the mid-point of said strap body and is connected to said strap body by a plurality of arms.

3. A lifting and securing strap assembly as claimed in claim 1 wherein said toothed section formed on the other end of said strap comprises a plurality of angled notches cut transversely across said strap body.

4. A lifting and securing strap assembly as claimed in claim 3 wherein each of said notches defines a vertical wall and an angular wall leading into said vertical wall.

5. A lifting and securing strap assembly as claimed in claim 1 wherein said lifting and securing strap is constructed of nylon.

6. A lifting and securing strap assembly as claimed in claim 1 wherein said strap is integrally formed and molded of one piece plastic from the group consisting of nylon, polyethylene and polypropylene.

7. A lifting and securing strap for a water bottle comprising a flexible plastic flat surfaced strap body, a handle assembly mounted to said strap body, said handle assembly comprising a handle formed with grips and arms mounted to each end of said handle extending angularly toward and secured to said strap, a locking and releasing mechanism formed on one end of said strap body and a notched locking section formed on the opposite end of said strap body, said locking and releasing mechanism comprising a base section, a channel forming section mounted to and positioned above said base section and a moveable locking tab provided with a locking rib secured to and extending from said channel forming section to receive the notched end formed on the other end of said strap body and hold the same in a secured position by engaging a notch on said notched end with a locking rib.

8. A lifting and securing strap as claimed in claim 7 wherein said locking and releasing mechanism includes a guide loop secured to said base section of said locking and releasing mechanism.

9. A lifting and securing strap for a water bottle comprising a flexible flat surfaced plastic strap body, a handle assembly including a handle provided with angularly positioned arm members secured to each end of said handle and mounted to said strap body with said handle being spaced away from said strap body, a locking and releasing mechanism formed on one end of said strap body and a notched locking section formed on the opposite end of said body, said locking and releasing mechanism comprising a base section, a channel forming section mounted to and positioned above said base section and a moveable flexible locking tab secured to said channel forming section, said flexible locking tab being provided with a locking rib which extends across a surface of said flexible locking tab to be received in a notch of said notched locking section formed on the opposite end of said strap body and hold the same in a secured locked position.

10. A lifting and securing strap as claimed in claim 9 wherein said plastic is nylon.

11. A lifting and securing strap as claimed in claim 9 wherein said locking and releasing mechanism includes a strap guide member to guide and hold said strap body.

12. A lifting and securing strap as claimed in claim 9 wherein said locking tab has a sloped under surface.

13. A lifting and securing strap as claimed in claim 9 wherein said locking and releasing mechanism has a transverse flange member extending therefrom at one end.

14. A lifting and securing strap as claimed in claim 9 wherein said plastic is a group consisting of nylon, polypropylene, and high density polyethylene.

15. A plastic lifting and securing strap assembly comprising a flexible plastic strap body, a handle mounted to said strap body, a locking and releasing mechanism formed on one end of said strap body and a toothed section formed on the other end of said strap body adapted to be releasably held in said locking and releasing mechanism, said locking and releasing mechanism comprising a base section, a stepped section positioned above said base section defining a throughgoing channel and a moveable locking tab secured to said stepped section for engaging said toothed section formed on the other end of said strap body and a guide loop secured to said one end of said strap body positioned away from said locking tab.

16. A plastic lifting and securing strap assembly as claimed in claim 15 wherein said locking and releasing mechanism has a transverse flange member extending therefrom at a distal end.

17. A lifting and securing strap for a water bottle comprising a flexible plastic flat surfaced strap body, a handle assembly mounted to said strap body, a locking and releasing mechanism formed on one end of said strap body and a notched locking section formed on the opposite end of said strap body, said strap notched end defining a plurality of angularly formed notches transversely cut into a flat planar surface of said strap body and a stop member secured to said strap body distal from said notched end extending transverse from said flat planar surface of said strap body, said locking and releasing mechanism comprising a base section, a channel forming section mounted to and positioned above said base section and a moveable locking tab provided with a locking rib secured to and extending from said channel forming section to receive the notched end formed on the other end of said strap body and hold the same in a secured position by engaging a notch on said notched end with a locking rib.

* * * * *